US006649135B1

(12) United States Patent
Staab et al.

(10) Patent No.: US 6,649,135 B1
(45) Date of Patent: Nov. 18, 2003

(54) METHOD OF COMBUSTION OR GASIFICATION IN A CIRCULATING FLUIDIZED BED

(75) Inventors: Werner-Friedrich Staab, Rosbach (DE); Wolfgang Pauly, Bad Homburg (DE); Niels Henriksen, Fredericia (DK)

(73) Assignee: MG Technologies AG, Frankfurt am Main (DE)

( * ) Notice: Subject to any disclaimer, the term of this patent is extended or adjusted under 35 U.S.C. 154(b) by 0 days.

(21) Appl. No.: 09/647,630

(22) PCT Filed: Jan. 19, 2000

(86) PCT No.: PCT/EP00/00378

§ 371 (c)(1),
(2), (4) Date: Oct. 29, 2001

(87) PCT Pub. No.: WO00/45091

PCT Pub. Date: Aug. 3, 2000

(30) Foreign Application Priority Data

Jan. 29, 1999 (DE) ..... 199 03 510

(51) Int. Cl.[7] ..... A62D 3/00

(52) U.S. Cl. ..... 423/240 R; 423/240 S; 588/205; 588/228

(58) Field of Search ..... 423/659, 240 R, 423/240 S; 588/205, 228

(56) References Cited

U.S. PATENT DOCUMENTS 5,220,112 A * 6/1993 Bucci et al. ..... 588/256
5,245,120 A * 9/1993 Srinivasachar et al. ..... 588/256

FOREIGN PATENT DOCUMENTS

WO WO 9746829 A1 * 12/1997 ..... F22B/31/00

* cited by examiner

*Primary Examiner*—Stanley S. Silverman
*Assistant Examiner*—Edward M. Johnson
(74) *Attorney, Agent, or Firm*—Herberg Dubno

(57) ABSTRACT

A material containing combustible components is burned or gasified in a circulating fluidized bed comprising a turbulence chamber, a solids separator connected to the upper area of the turbulence chamber, a return line leading from the solids separator to the turbulence chamber and a cooling device for the indirect cooling of solids arriving from the solids separator. The cooling device comprises several fluidized beds through which the solids pass one after the other. The first fluidized bed, into which the hot solids arriving from the solids separator are introduced first, is situated in a dechlorinating chamber. Fluidizing gas and at least one of the following dechlorinating additives: a) gaseous $SO_2$ or a material which contains sulfur and releases $SO_2$ in an oxidizing atmosphere, b) silicates and aluminium silicates, c) activated silicate, or d) other alkali-binding and HCl-releasing additives, are also introduced into the dechlorinating chamber in at least stoichiometric quantities so as to convert the alkali and metal chlorides contained in the arriving solids.

4 Claims, 1 Drawing Sheet

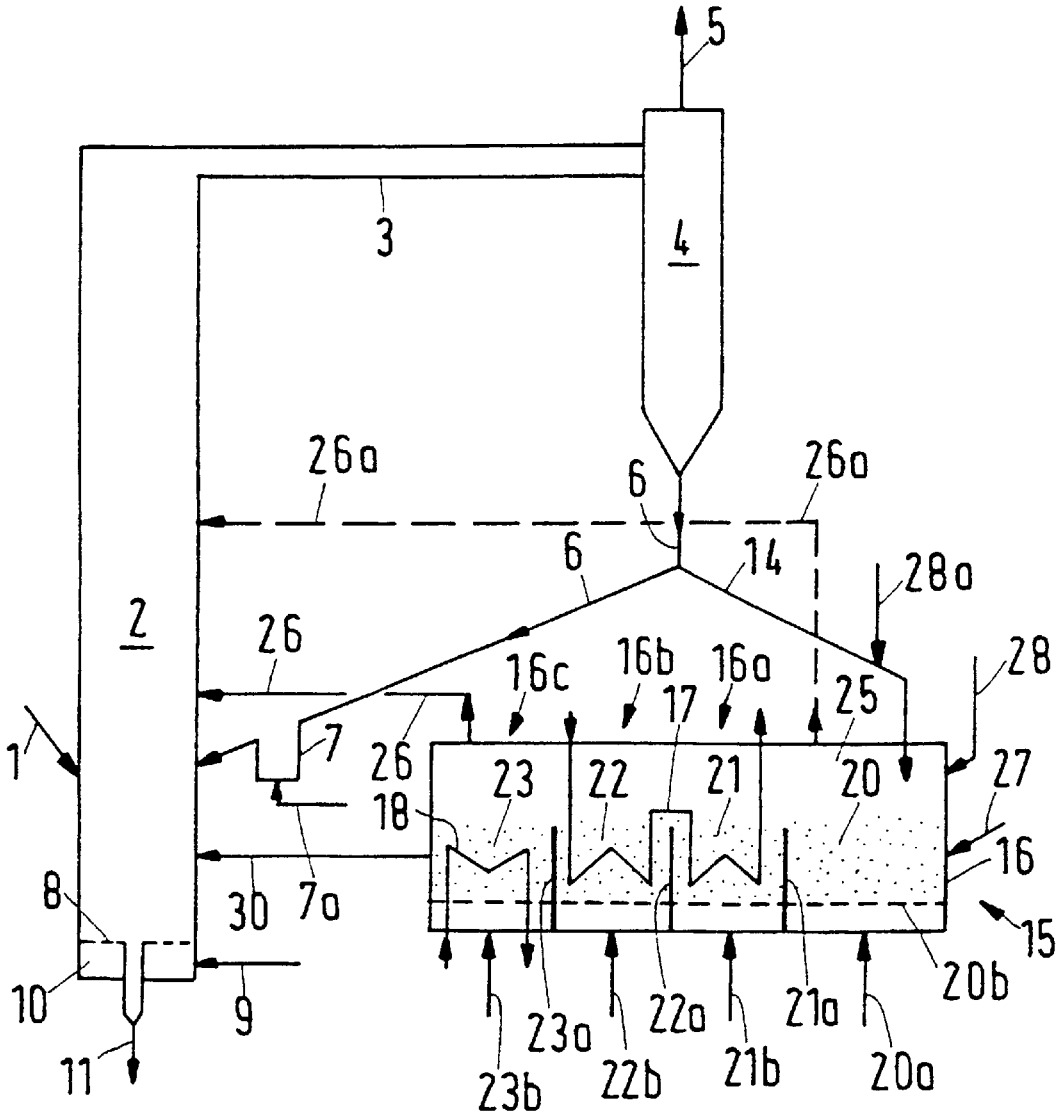
5
4
3
26a
6
26a
6
14
28a
2
26
16c
16b
16a
17
25
28
1
7
26
23
22
21
20
27
18
16
8
30
7a
15
10
9
23a
22a
21a
20b
11
23b
22b
21b
20a

METHOD OF COMBUSTION OR GASIFICATION IN A CIRCULATING FLUIDIZED BED

The invention relates to a method of combustion or gasification of material containing composite components in a circulating fluidized bed which has a turbulence chamber for the combustion or gasification, a solids separator connected with the upper region of the turbulence chamber, a recycle from the solids separator of the deposited solids to the turbulence chamber and a cooling unit for the indirect cooling of solids which come from the solids separator, whereby the cooling unit includes a plurality of fluidized beds through which the solids migrate, one after the other.

The method of this type is known from WO 97 46 829 A1. Here the cooling unit is preceded by an uncooled fluidized bed whose flue gas is fed directly to the combustion. Because of this feature, the chloride concentration in the solids to be cooled are reduced. The chlorides are responsible for aggressive corrosive attack on the cooling unit. The known blowing through of the fluidized bed is above all not suitable in inappropriate cases, of lowering the chloride concentration of the solids to be cooled sufficiently to ensure the desired protection against corrosion. Especially corrosive are, for example, HCl encrustations on the cooling tubes.

The invention has the object of so treating the hot solids coming from the solids separator that their corrosivity in the cooling unit completely or substantially completely disappears. According to the invention this is effected in the method described at the outset in that the first fluidized bed into which the hot solids coming from the solids separator is first conducted is a dechlorination chamber whereby in this dechlorination temperature at a temperature of the solids in the range of 700 to 1100° C. and in the presence of a fluidizing gas and at least one dechlorination additive which can be a) a gaseous $SO_2$ or a sulfur-containing material that liberates $SO_2$ in an oxidizing atmosphere, b) a silicate, laminate silicate, c) activated silicate, or d) other alkali additive compounds which liberate HCl, is added in at least a stoichiometric quantity to convert the alkali and metal chlorides contained in the supplied solids.

As solid additives, various aluminum silicates, for example, kaolinite have proved to be effective. Also suitable are activated silicates (for example commercial ICA 5000), whereby the activation is achieved by boiling in sodium hydroxide. Economical is the use of waste substances, for example, chloride-free clarifier sludge or contaminated earth which contain these additives.

The reaction capabilities of the silicate, aluminum silicates, or the activated silicates depends substantially upon the hydroxyl groups on the silicon. These additives bind the alkali and metal in the hot solids so that chlorine is liberated as HCl which is less corrosive than, for example, alkali or metal chlorides. Usually these solid additives are fed in powder form into the fluidized beds whereby the mean particle size $d_{50}$ lies approximately in the range of 50 to 500 $\mu$m. A gradual supply of the solid additive to the feed line of the hot solids is also possible.

Gaseous $SO_2$ is above all suitable for reaction with alkali chlorides or metal chlorides in a vapor form and thus to form sulfate and HCl in the presence of molecular oxygen. The liberated HCl is driven off with the fluidizing gas from the dechlorination chamber. Sulfates are not corrosive or are scarcely corrosive and can be disposed of with the ash discharged from the process.

One can supply $SO_2$ in the gas space in a molar concentration of 0.25 to about 6 times the concentration of the liberated HCl. The $SO_2$ can also be introduced as sulfur-containing materials which release $SO_2$ at the higher temperatures in the dechlorination chamber or liberate $SO_2$ in oxidizing atmospheres.

The fluidized bed in the dechlorination chamber can operate with or without indirect cooling; usually this fluidized bed is maintained free from an indirect cooling. The remaining fluidized beds in the cooling unit contain heat exchangers provided by liquid gas or vapor coolants. By eliminating or at least reducing the corrosivity of the hot solids, one can maintain the temperature in the hottest fluidization bed high which, for example, can benefit the vapor superheating.

The material to be combusted or gasified can be of different types. It can thus be, for example, coal, lignite, biomass (e.g. wood or straw), solid and/or liquid wastes or clarifier sludge whereby, in addition, several of the aforementioned materials can be mixed.

BRIEF DESCRIPTION OF THE FIGURE

The variants of the process are detailed with the aid of the drawing. The drawing shows a flow diagram of the process.

The material to be combusted or to be gasified is supplied through the duct (1) to the turbulence chamber (2) which belongs to a circulating fluidized bed. The upper region of the turbulence chamber (2) is connected by the duct (3) to a solids separator (4) which can, for example, be a cyclone. Partly dedusted gas is withdrawn via the duct, (5) and is supplied to a cooling and cleaning known per se and not illustrated. A part of the solids settling in the separator (6) are returned to the turbulence chamber (2) by a recycle duct (6) via a siphon (7). The flow in the siphon is controlled by a fluidizing gas stream which is supplied in the duct **(7*a*)**.

The lower region of the turbulence chamber (2) has a grate (8) from which the oxygen-containing fluidizing gas streams upwardly in the chamber. The fluidizing gas arrives by the duct (9) and initially passes through a distributing chamber (10) before it flows through the grate. Ash is removed via the outlet (11) from the chamber (2). The combustable or gasifiable material can be a variety of granular solids with combustable components. In addition, liquid or pasty substances can be added to it. The temperatures in the turbulence chamber (2) usually lie in the range of 700 to 1100° C. and preferably 800 to 1050° C. With the fluidizing gas, a part of the solids is continuously passed via the duct (3) to the separator (4). The quantities of the solids which are recycled through the recycle duct 6 into the turbulence chamber (2) usually amounts to at least 5 times the quantity of the solids, per hour which is on average found in the turbulence chamber (2).

A part of the hot solids settling in the separator (4), which has a temperature in the range of 700 to 1100° C. and usually 800 to 1050° C. are fed through the duct (14) of cooling unit (15). In the present case, the cooling apparatus (15) has a dechlorination chamber (16) and three cooling chambers **(16*a*), (16*b*) and (16*c*). The cooling chambers contain heat exchangers (17) and (18) for indirect cooling of the solids which are there provided as fluidized beds (21), (22) and (23). Between the beds their weir-like chamber walls (21*a*), (22*a*) and (23*a*). Fluidizing gas is supplied through ducts (21*b*), (22*b*) and (23*b*)**. The fluidizing gas can be for example air.

The dechlorination chamber (16) has a feed duct (21*a*) for fluidizing gas (e.g. air), this gas flowing through a grate (20*b*) into a fluidized bed (20) and then passing initially into the gas space (25) found above the fluidized bed (20). The gas space is also found above the other fluid beds (21), (22) and (23). The gas discharge is effected via a collecting duct (26) which opens into the turbulence chamber 2 and thereby feeds the discharged gas of the cooled fluidized beds (21), (22), (23) through it. Alternatively, the dechlorination chamber (16) has its own gas discharge line (26*a*) which is indicated in broken lines.

To lower corrosivity of the hot solids past the duct (14) to a minimum, the dechlorination chamber (16) is provided with a feed duct (27) for solid additives that feed duct (28) for gaseous additives. The gaseous additives can be entirely or partly supplied also through the duct (28*a*). Solid additives are silicates, aluminum silicates and/or activated silicates or mixtures containing at least one of these additives. As gaseous additives one utilizes gaseous $SO_2$ or other sulfur-containing materials which liberate $SO_2$ in oxidizing atmosphere. What is important is that the content of alkali chlorides and metal chlorides which are supplied with the hot solids through the line (14) are largely reduced by the additives. Preferably the solids which pass over the weir-like wall (21*a*) of the dechlorination chamber (16) into the fluidized bed (21) have at most 20% of the alkali chloride and metal chloride content which was present in the solids of line (14). The cooled solids which partly surrender their heat in the cooling device (15) in which as a coolant, for example, boiler feed water or steam can be used, as recycled via the line (30) into the turbulence chamber (2). A part of the cooled solids can also be removed from the process although this has not been shown in the drawing.

EXAMPLE

In an apparatus corresponding to that of the drawing which, a part of the dechlorination chamber (16) has only two cooling chambers (16*a*) and (16*b*), a mixture is fed to the turbulence chamber (2) per hour and 121,000 kg of granular coal and 41,000 kg of straw and burned at a temperature of 850° C. Through the line (14), one adds 16,200 kg/h of ash with a chlorine content of 0.002 weight % to the dechlorination chamber (16) which has a base area of 1.5×0.8 and a height of 1.6 m. The height of the fluidized by (20) amounts to 1 m. The chamber (16) is supplied with a solids additive in the form of 23 kg/h of the activated silicate ICA 2000 the activated silicate ICA (manufacturer: ICA Chemie, A-3384 Gross Sierning) and has a gaseous additive with $SO_2$ through the ducts (27) or (28) whereby in the gas space (25) a concentration of 30 ppm $SO_2$ is established. From the cooling chamber (16*b*) one withdraws ash cooled to 720° C. through the duct (30) and recycles it back into the turbulence chamber (2). By the treatment in the dechlorination chamber (16), the chlorine content in the solids is reduced to 10% of the starting content.

What is claimed is:

1. A method of combusting or gasifying material containing combustible components in a circulating fluidized bed which has a turbulence chamber for the combustion or gasification, a solids separator connected with the upper region of the turbulence chamber, a recycle from the solids separator of settled solids to the turbulence chamber and a cooling device for the indirect cooling of solids which come from the solids separator, in which the chlorine device includes several fluidized beds through which the solids migrate one after the other, characterized in that the first fluidized bed in which the hot solids arrive initially form the solids separator, whereby with fluidizing gas at temperatures in the range of 700 to 1100° C. and the presence of at least one dechlorination additive in the form of a) gaseous $SO_2$ or sulfur-containing material which liberates $SO_2$ in oxidizing atmosphere, b) silicates and aluminum silicates, c) activated silicates, or d) other alkali binding and HCl liberating additives which are supplied in at least stoichiometric quantity, the alkali quantities and metal chlorides of the solids supplied are reactivated.

2. The method according to claim 1 characterized in that the fluidized bed in the dechlorination chamber is free from an indirect cooling.

3. The method according to claim 1 characterized in that the silicates, aluminum silicates and/or activated silicates are added to the fluidized bed of the dechlorination chamber and that gaseous $SO_2$ or other sulfur-containing materials which liberate $SO_2$ in oxidizing atmospheres are supplied to the gas space above the fluidized bed in the dechlorination chamber.

4. The method according to claim 1 characterized in that the material to be combusted or gasified contains solid and/or liquid wastes.

* * * * *